US005924659A

United States Patent [19]

Babcock

[11] Patent Number: 5,924,659

[45] Date of Patent: Jul. 20, 1999

[54] GRASPING APPARATUS AND METHOD FOR HOLDING A CONTAINER IN AN INVERTED POSITION

[76] Inventor: Sarah C. Babcock, 2843 Holyfield Rd., Elon College, N.C. 27244

[21] Appl. No.: 08/845,613

[22] Filed: Apr. 28, 1997

[51] Int. Cl.[6] ..... A47G 23/02

[52] U.S. Cl. ..... 248/146; 248/106; 248/311.3

[58] Field of Search ..... 248/146, 149, 248/132, 157, 154, 416, 418, 333, 106, 97, 105, 109, 312.1, 313, 315, 231.12; 47/40.5; 53/390; 126/29; 222/577

[56] References Cited

U.S. PATENT DOCUMENTS

| | | | |
|---|---|---|---|
| 2,557,570 | 6/1951 | Seiger | 248/106 |
| 3,185,780 | 5/1965 | De Falla | 248/157 |
| 3,224,595 | 12/1965 | Sherley | 248/154 |
| 3,589,338 | 6/1971 | Lovitz | 248/311.3 |
| 4,271,878 | 6/1981 | Bologa | 248/146 |

*Primary Examiner*—Leslie A. Braun
*Assistant Examiner*—Willie Berry, Jr.
*Attorney, Agent, or Firm*—Jenkins & Wilson, P.A.

[57] ABSTRACT

A grasping apparatus is provided for grasping and holding containers of various sizes and shapes in an inverted position for draining the contents therefrom whereby the container can be left unattended. The grasping apparatus includes a base platform with a support arm extending therefrom and having an extension section which is selectively adjustable for height. A pair of grasping arms is provided and attached to the top of the support arm for grasping and holding a container therebetween. The grasping arms are selectively adjustable to grasp and hold containers of various sizes and shapes in an inverted position.

8 Claims, 2 Drawing Sheets

GRASPING APPARATUS AND METHOD FOR HOLDING A CONTAINER IN AN INVERTED POSITION

TECHNICAL FIELD

The present invention relates generally to grasping apparatuses and methods, and more particularly, to a novel grasping apparatus and method for holding a container in an inverted position.

RELATED ART

Various grasping apparatuses and methods exist for grasping and holding a variety of containers, some of which can be in an inverted position.

U.S. Pat. No. 2,063,554 to Meyerson discloses a bottle holder which can be adapted for holding a baby bottle in a slightly inverted position. The bottle holder comprises a hollow conical base and an upright U-shaped bracket centrally secured to the base. A sleeve is pivotally attached to the bracket at one end thereof, and a bottle can be positioned and held within the sleeve.

U.S. Pat. No. 4,093,165 to Sussman also discloses a device for holding a baby bottle. The device includes a cage for removably retaining a baby bottle at an erect angle, a suction cup adapted to grip a flat surface and a swivel mechanism for rotatably joining the bottle cage to the suction cup. The cage is rotatable about a vertical axis relatively freely through an arc in the range of 180° so that the cage and the baby bottle therein can be swung away from a baby when so desired.

U.S. Pat. No. 4,513,935 to Aguirre discloses yet another apparatus for supporting a baby bottle. The apparatus consists of a tripod from which two strings hang therefrom wherein a wire framework supporting a baby bottle can be attached to the strings such that the tripod can support the baby bottle.

Despite the prior art apparatuses for grasping and holding a container, there remains room for improvement in the art for a novel grasping apparatus for grasping and holding containers of various sizes in an inverted position.

DISCLOSURE OF THE INVENTION

The present invention provides a novel grasping apparatus and method for grasping and holding containers of various sizes and shapes in an inverted position for draining the contents therefrom whereby the container can be left unattended. The grasping apparatus comprises a base platform with a support arm extending therefrom and having an extension section which is selectively adjustable for height. Grasping means in the form of a pair of grasping arms is provided and attached to the top of the support arm for grasping and holding a container therebetween. The grasping arms are selectively adjustable to grasp and hold containers of various sizes and shapes in an inverted position.

It is therefore an object of the present invention to provide a novel grasping apparatus and method for grasping and holding a container in an inverted position for draining the contents therefrom whereby the container can be left unattended.

It is another object of the present invention to provide a grasping apparatus and method which is selectively adjustable for grasping and holding containers of various sizes and shapes in an inverted position.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
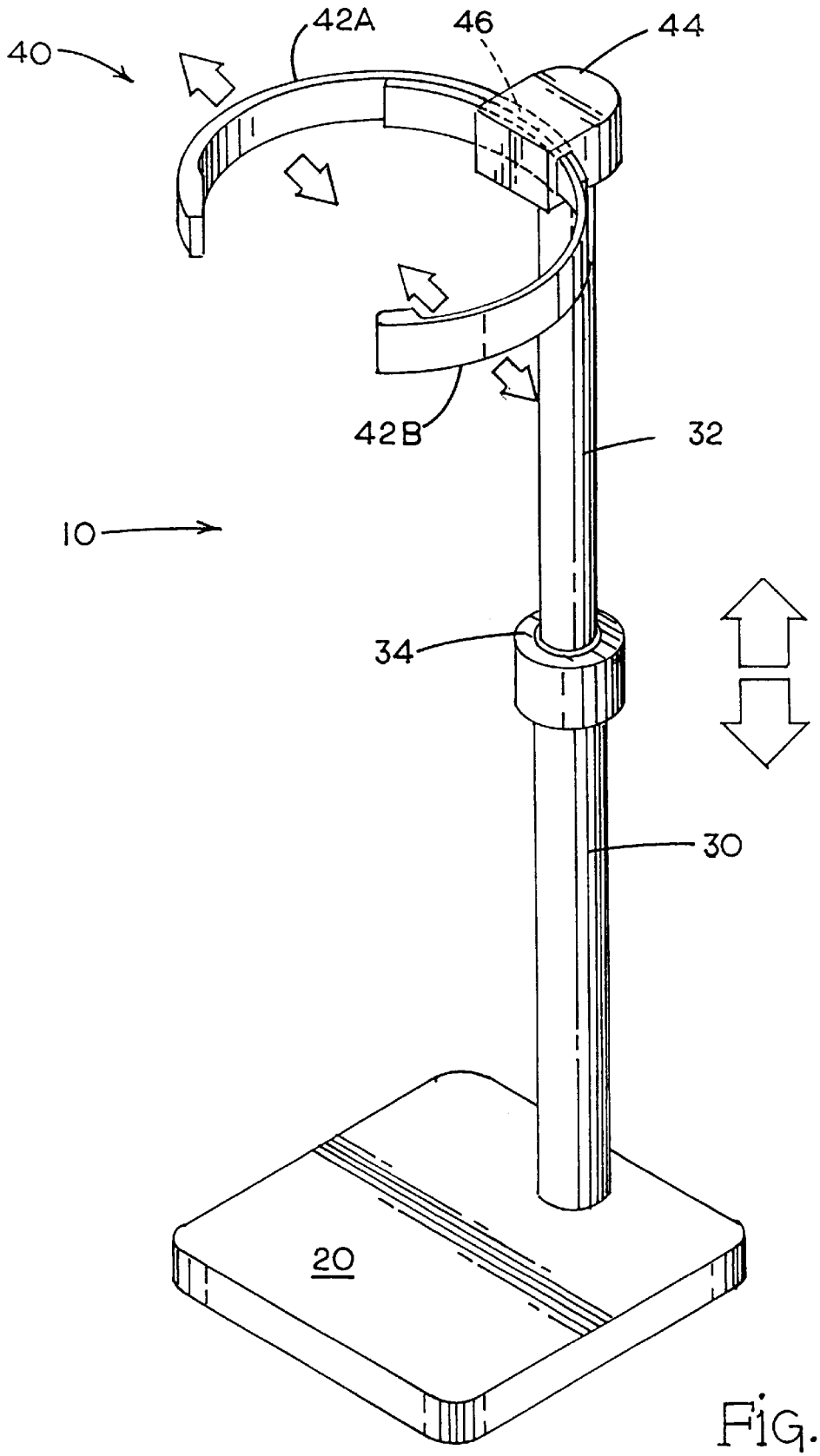
FIG. 1 of the drawings is a perspective view of a preferred embodiment of the grasping apparatus of this invention.
Figure 2:
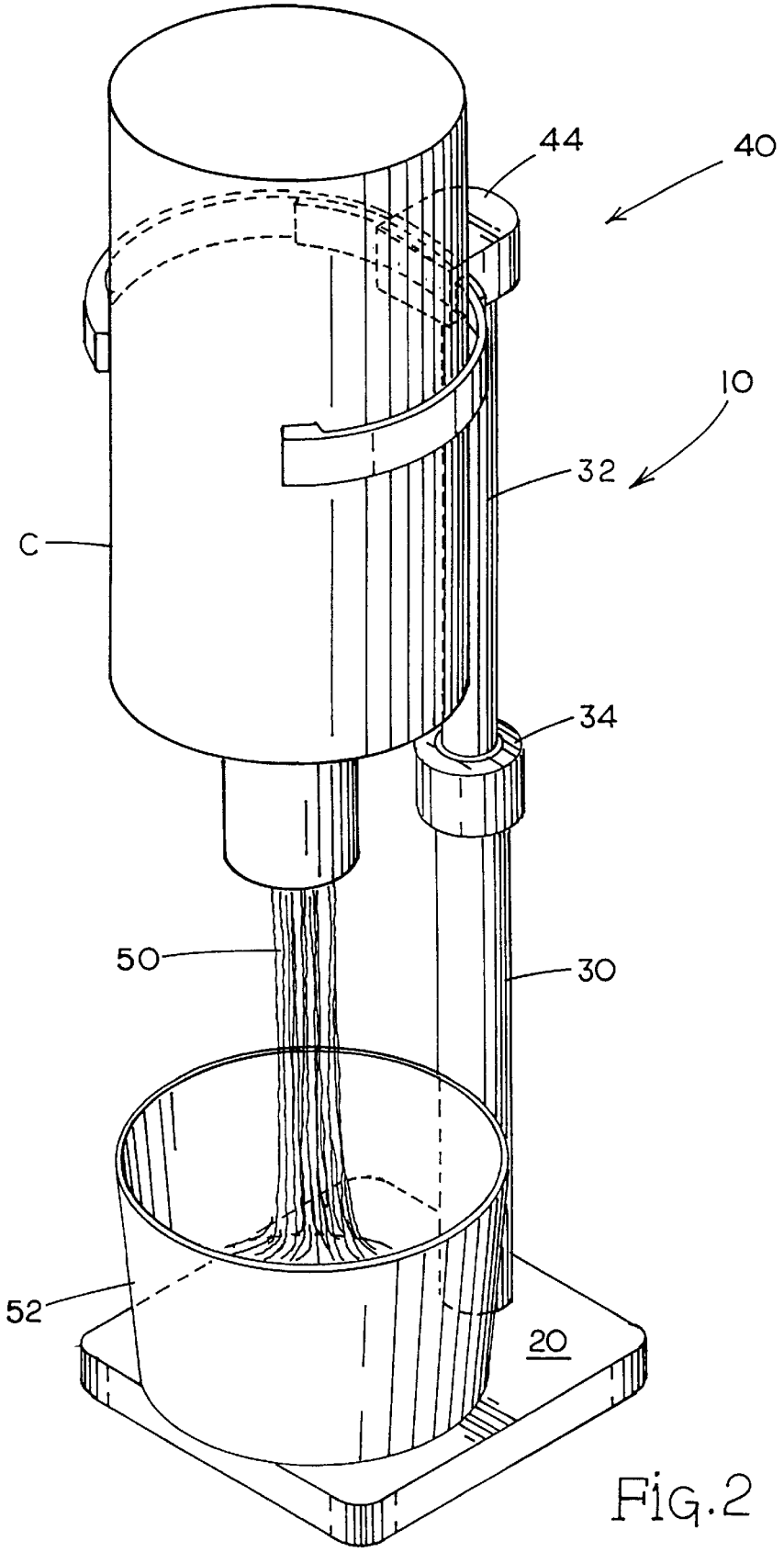
FIG. 2 of the drawings is a Perspective view of the grasping apparatus shown in FIG. 1 holding a container in an inverted position with its contents being drained therefrom.

In accordance with the present invention and referring to FIGS. 1 and 2 of the drawings, grasping apparatus generally designated 10 is illustrated and can hold a container in an inverted position for allowing the contents of the container to be drained therefrom while the container can be left unattended. Although grasping apparatus 10 can be of any suitable size, it is approximately twelve (12) inches high and approximately four (4) inches wide in one embodiment.

Container C comprises a base platform 20 for supporting grasping apparatus 10 in an upright position. Base platform 20 can be of any practically suitable construction, size and shape, and the bottom thereof can include means for preventing base platform 20 from slipping, such as, for example, rubber buttons. It is also envisioned according to this invention that base platform 20 could comprise a bracket which is securable to another structure such as, for example, a countertop or bench.

A support arm 30 extends vertically upward from base platform 20 and can be a rod of suitable contruction such as metal or plastic. Support arm 30 can be attached to base platform 20 or formed as an integral part thereof. According to this invention, support arm 30 includes at least one extension section 32 which is selectively extendable from and retractable within at least a portion of the remainder of support arm 30. As shown, extension section 32 is narrower in diameter than the lower remainder portion of support arm 30 and is therefore telescopically slidable within the remainder of support arm 30 so that the height of support arm 30 can be selectively adjusted quickly and easily. Support arm 30 includes means for securely maintaining extension section 32 in a desired position of extension with respect to the remainder of support arm 30, which is shown in the preferred embodiment as ring 34 which can include inner threads (not shown) for engaging outer threads (not shown) which can be defined around the top outer end of the non-extendable portion of support arm 30. Ring 34 can therefore be loosened to allow extension section 32 to be slidably adjustable and tightened to secure and lock extension section 32 in place.

On an end of support arm 30 opposite base platform 20, grasping apparatus 10 includes grasping means generally designated 40 for grasping and holding a container in an inverted position for tasks such as, for example, draining the contents therefrom. Grasping means 40 is shown in the preferred embodiment in FIGS. 1 and 2 as a pair of grasping members 42A and 42B which are overlapping bands at least substantially forming a C-shape. Grasping members 42A and 42B each extend through and perpendicularly from top block 44 which is positioned at the top of support arm 30. Top block 44 can be attached to support arm 30 or formed as an integral part thereof and defines a slot 46 therethrough for passage of grasping members 42A and 42B in an adjacently overlapping manner as shown in phantom in FIG. 1.

In accordance with this invention, grasping members 42A and 42B are slidably movable within and through slot 46 of block 44 so that they can be moved toward and away from one another. In this manner, grasping members 42A and 42B can be selectively adjusted to grasp and hold inverted containers of various sizes therebetween. Grasping members 42A and 42B can be fitted within slot 46 so as to allow slidable movement of grasping members 42A and 42B while maintaining sufficient pressure on the overlapping portions of grasping members 42A and 42B for grasping members 42A and 42B to be able to firmly and securely grasp and hold containers of various sizes therebetween.

Referring now specifically to FIG. 2 of the drawings, grasping apparatus 10 is shown with a container C being grasped between and held by grasping members 42A and 42B in an inverted position with its contents 50 being drained therefrom into another container 52. It is envisioned according to this invention that container C could be a container of any size and shape suitable for being grasped between and held by grasping arms 42A and 42B in an inverted position such as, for example, a pasta container, a ketchup bottle, a salad dressing container or other similarly suitable containers. Support arm 30 can be selectively adjusted for a height at which it is desired to hold container container C in a vertically spaced-apart manner from base platform 20, and support arm 30 can be positioned where container C is held directly above base platform 20 or not directly thereabove as extension section 32 of support arm 30 can swivel three hundred and sixty degrees (360°). Grasping arms 42A and 42B can be selectively adjusted to grasp and hold container C by sliding them toward one another substantially around container C such that grasping arms 42A and 42B form a C-shape. As can be appreciated, the outer ends of grasping arms 42A and 42B can be closer to one another or even contact and/or overlap one another when smaller containers are grasped by and held between grasping arms 42A and 42B. Once container C is securely grasped and held by grasping arms 42A and 42B in an inverted posotion, contents 50 can be allowed to drain therefrom.

It is therefore seen that the present invention provides a novel grasping apparatus and method for grasping and holding containers in an inverted position. It is also seen that the present invention provides a grasping apparatus and method which is selectively adjustable for grasping and holding containers of various sizes in an inverted position.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A grasping apparatus for grasping and holding a container in an inverted position, said grasping apparatus comprising:

(a) a base platform;

(b) an elongated support arm extending substantially vertically from said base platform, said support arm being selectively adjustable for height by said support arm including at least one extension section telescopically extendable from and retractable within at least a portion of said support arm, and said support arm further comprising a ring for maintaining said extension section in a desired position of extension;

(c) a block positioned on top of said extension section of said support arm, said block defining a slot therethrough; and (d) adjustable grasping means attached to an end of said support arm opposite said base platform for holding a container in an inverted position spaced-apart from said base platform, said grasping means comprising a pair of grasping arms adapted for cooperatively grasping and holding a container in an inverted position spaced-apart from said base platform, said grasping arms comprising separate overlapping bands both extending through said slot defined by said block in a direction perpendicular to said block and together forming a C-shape, said bands being independently selectively adjustably movable toward and away from one another for grasping and holding therebetween containers of various sizes in an inverted position, said grasping arms being selectively adjustably movable toward and away from one another for grasping and holding therebetween containers of various sizes in an inverted position.

2. The grasping apparatus of claim 1 wherein said support arm comprises an elongated rod.

3. The grasping apparatus of claim 1 wherein said grasping arms extend substantially perpendicularly from said support arm.

4. The grasping apparatus of claim 1 wherein said grasping arms together substantially form a C-shape.

5. The grasping apparatus of claim 4 wherein said grasping arms are bands which overlap one another.

6. A method of grasping and holding a container in an inverted position, said method comprising the steps of:

(a) providing a grasping apparatus comprising:

(i) a base platform;

(ii) an elongated support arm extending substantially vertically from said base platform, said support arm being selectively adjustable for height by said support arm including at least one extension section telescopically extendable from and retractable within at least a portion of said support arm, and said support arm further comprising a ring for maintaining said extension section in a desired position of extension;

(iii) a block positioned on top of said extension section of said support arm, said block defining a slot therethrough; and (iv) adjustable grasping means attached to an end of said support arm opposite said base platform for holding a container in an inverted position spaced-apart from said base platform, said grasping means comprising a pair of grasping arms adapted for cooperatively grasping and holding a container in an inverted position spaced-apart from said base platform, said grasping arms comprising separate overlapping bands both extending through said slot defined by said block in a direction perpendicular to said block and together forming a C-shape, said bands being independently selectively adjustably movable toward and away from one another for grasping and holding therebetween containers of various sizes in an inverted position;

(b) adjusting said extension section of said support arm to a desired height and then maintaining said extension section at said desired;

(c) placing an inverted container between said grasping arms and selectively adjusting said grasping arms independently such that they grasp and hold said inverted container in a spaced-apart position from said base platform.

7. The method of claim 6 wherein said grasping arms are selectively adjusted by independently sliding said grasping arms toward one another to grasp and hold said inverted container whereby said grasping arms substantially form a C-shape.

8. The method of claim 6 further comprising the step of allowing contents within said inverted container to drain from said container while said inverted container is being grasped and held by said grasping arms.

* * * * *